United States Patent [19]

Blum

[11] Patent Number: 4,491,816

[45] Date of Patent: Jan. 1, 1985

[54] TRANSDUCER FOR ALTERNATING CURRENT LIMITER

[75] Inventor: Alex Blum, Unterentfelden, Switzerland

[73] Assignee: Sprecher & Schuh AG, Aarau, Switzerland

[21] Appl. No.: 382,759

[22] Filed: May 27, 1982

[30] Foreign Application Priority Data

Dec. 14, 1981 [EP] European Pat. Off. ..... 81 110 410.8

[51] Int. Cl.[3] ..... H01F 7/10

[52] U.S. Cl. ..... 335/245; 335/249; 335/261

[58] Field of Search ..... 335/245, 247, 248, 249, 335/251, 261, 279

[56] References Cited

U.S. PATENT DOCUMENTS

| | | | |
|---|---|---|---|
| 506,282 | 10/1893 | Timmis | 335/261 |
| 750,132 | 1/1904 | Timmis et al. | 335/261 |
| 2,407,963 | 9/1946 | Persons | 335/261 |

*Primary Examiner*—George Harris

*Attorney, Agent, or Firm*—Ladas & Parry

[57] ABSTRACT

The transducer comprises an armature and a core. Both pieces are E-shaped, and their geometrical dimensions are chosen so that when their central legs come into mutual contact, air gaps still exist between both pairs of outer legs where these face each other. A coil bobbin is fixed to the core and forms a straight guide for the central leg of the armature. The frontal surfaces of the outer legs are chamfered so that the limiting surfaces of the air gaps are inclined with respect to the travel direction of the armature. In order to minimize the hum, a short-circuit ring is embedded into the central leg of the core.

7 Claims, 3 Drawing Figures

TRANSDUCER FOR ALTERNATING CURRENT LIMITER

BACKGROUND OF THE INVENTION

The invention relates to the electromechanical transducer of a limiter switch for alternating current, with an E-shaped armature and an E- or C-shaped core as described, for instance, in the Swiss Pat. No. 552.278. Such transducers have two undesirable properties which influence each other, to wit the hum induced by the alternating current, which they emit in the activated state, and the tendency of stationary and mobile magnetic pieces to stick together due to residual magnetism. Two measures are known in the art to counteract these features. One is the use of short-circuit rings and the other a shaping of the magnetic pole surfaces which ensures that adequate air gaps remain in existence even during activation, in the region where core and armature touch each other.

It can be inferred, for instance, from the aforementioned patent, that the choice of the support points where core and armature rest on each other is very critical with regard to the hum behavior of the current limiter. For reasons of stability, the support points were hitherto always located on the outer legs of both E- and C-shaped iron pieces. In this case, the short-circuit rings mentioned above, which are made of a nonferromagnetic material having a good electrical conductivity such as hard copper or brass for instance, are also located in the region of the outer legs, and the ratio of the pole surface enclosed by the rings to the non-enclosed pole surface is chosen so as to obtain an optimal hum suppression.

In order to avoid the sticking together of both magnetic pieces, it is usual to ensure that in the activated state there remains an air gap in the region of the inner leg or legs in order to sufficiently reduce the residual magnetism. However, this allows a flexural vibration of the magnetic pieces, which are in mutual contact at the frontal surfaces of their outer legs, and will induce a residual hum which is practically impossible to suppress. Furthermore, the pole surfaces must be planned to a fairly high degree of precision, both on the outer legs where the surfaces rest on each other and in between where these surfaces define an air gap. Indeed, not only must this gap be shaped to a close tolerance, but the outer supporting surfaces must also be pairwise exactly coplanar. The manufacturing costs of such magnetic core pieces is correspondingly high. The goal of the present invention is to create a limiter switch for alternating current which can be produced economically and yet have excellent functioning characteristics.

SUMMARY OF THE INVENTION

According to the invention the aforesaid goal is achieved by a transducer comprising a coil shaped supporting bobbin and a pair of magnetic pieces forming an armature and a core. At least one of the armature and core has an E-shaped cross section. The central leg of the E-shaped piece comes into contact with the other piece when the transducer is activated. At least one of the central leg and the region of the other piece which faces it carry a short circuit ring. Air gaps remain between both pairs of outer legs of the magnetic pieces even when the transducer is activated. Main surfaces of pieces which define there gaps are slanted with respect to the travel direction of the armature.

The advantages of this construction are partly due to the fact that in the activated state, the contact surface between both magnetic pieces is comparatively small and, more important still, that it consists of a simple connected domain. In contrast to this, previous limiters had a physical contact surface divided into two parts, which must hence be aligned with great precision in order to ensure that both magnetic core pieces come into flush contact when activated. In particular the fairly general use of laminated core pieces consisting of a stack of metallic sheets requires either a costly high precision punching of the individual sheets, or else a supplementary planning of the pole surface after the sheets have been bonded to form a stack. In comparison, the maximum diameter of the contact region in a device according to the present invention is comparatively small, so that within it a sufficiently flush arrangement of the sheets in the stack can be obtained prior to the riveting of the stack. The latter then has a contact surface sufficiently plane within said domain to make a further grinding unnecessary. At the same time, the air gap adjacent to the outer legs requires much less close tolerances, because its cross section is much larger than would be the case if its boundary surfaces were not slanted. An inclination of the surfaces which face each other in the region of the outer legs has previously been suggested, but naturally only in the case that these surfaces are supporting surfaces, i.e. surfaces which physically rest on each other upon activation of the device, and thus do not delimit an air gap. But in this case the comparatively large extension of these surfaces requires a high precision of their finish in order to ensure an intimate mutual contact. Further, the difficulty of optimally locating a short-circuit ring in the vicinity of such slanted surfaces has restricted their use to limiters intended for direct current, and thus not prone to hum.

It should also be noted, that hum problems are less delicate when the supporting surface lies centrally and the air gaps laterally.

In a preferred embodiment the armature has a central leg which is guided by the bobbin which supports the coil. The relation of length to width of the guide pieces is then more advantageous than that which is obtainable for a guide surface lying on the outside, thus ensuring a greater reliability of the device.

BRIEF DESCRIPTION OF THE DRAWING

The invention will now be illustrated by the description of a preferred embodiment with reference to the drawings in which.

DETAILED DESCRIPTION OF A PREFERRED EMBODIMENT

Figure 1:
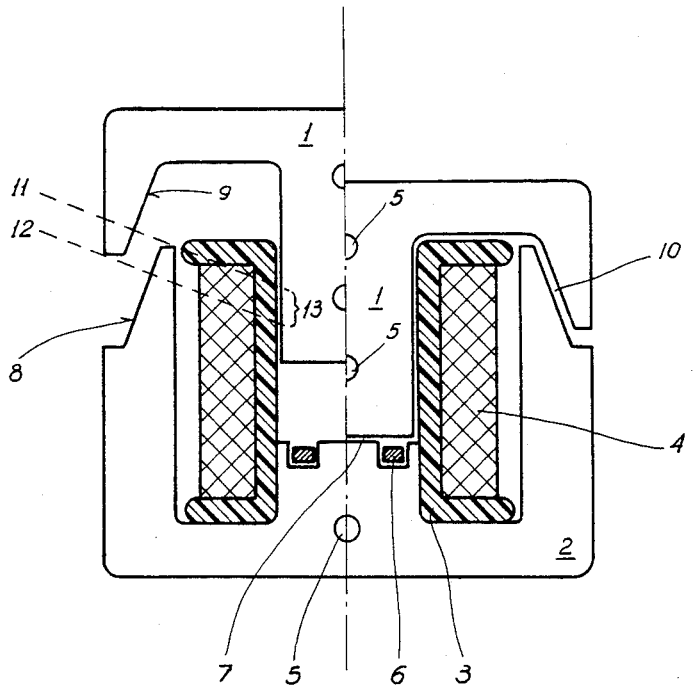
FIG. 1 shows two axial semi-sections of a first embodiment, in the nonactivated state on the left-hand side, and in the activated state on the right-hand side.

In FIG. 1 the mobile armature is designated by 1, the core by 2, the coil-supporting bobbin by 3, and the coil of the electromagnet by 4. The immobile bobbin 3 is made of an insulating material and acts as a guide for the central leg of the E-shaped armature 1, which consists of a stack of metal sheets clamped together by rivets 5. The core 2 is also E-shaped and laminated in the same way. When activated, the central leg of the armature rests on the somewhat shorter central leg of the core, in the region designated by 7. In order to suppress the hum due to vibrations, a short-circuit ring 6 is recessed in the central leg of the core. The inner surface of the bobbin 3 may also be provided with protrusions (not shown in the drawing) which hold the ring in its recess, and thus simplify the assembly operations.

At the places where the outer legs of both magnetic pieces face each other, their surfaces 8, 9 are chamfered and their dimensions chosen so an air gap 10 still remains between said surfaces when both central legs touch each other in 7. The chamfer of the outer legs provides a longer stroke for a given attractive force and also results in a certain self-centering action when both pieces are pulled together. The latter effect is particularly noticeable provided that the slice comprised between two imaginary planes 11, 12, normal to the chamfered surfaces and running across the edges of the same, traverses the bobbin and the central leg of the armature in a region 13 where the bobbin and the central leg are mutually engaged.

Figure 2:
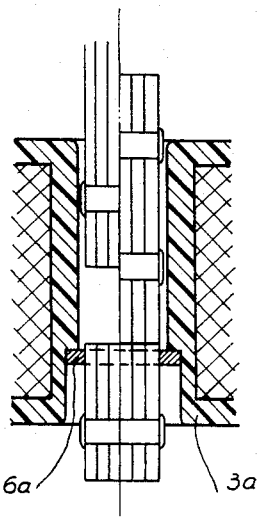
FIG. 2, taken along a line generally perpendicular to the lines along which the axial semi-section of FIGS. 1 and 3 are taken, shows two partial axial semi-sections of a second embodiment, in the non-actuated state on the left-hand side, and in the actuated state on the right-hand side.

The operation of the embodiment shown in FIG. 2 is identical to that of FIG. 1. However, the short circuit ring 6*a* is held in place by shoulders on the bobbin 3*a*.

Figure 3:
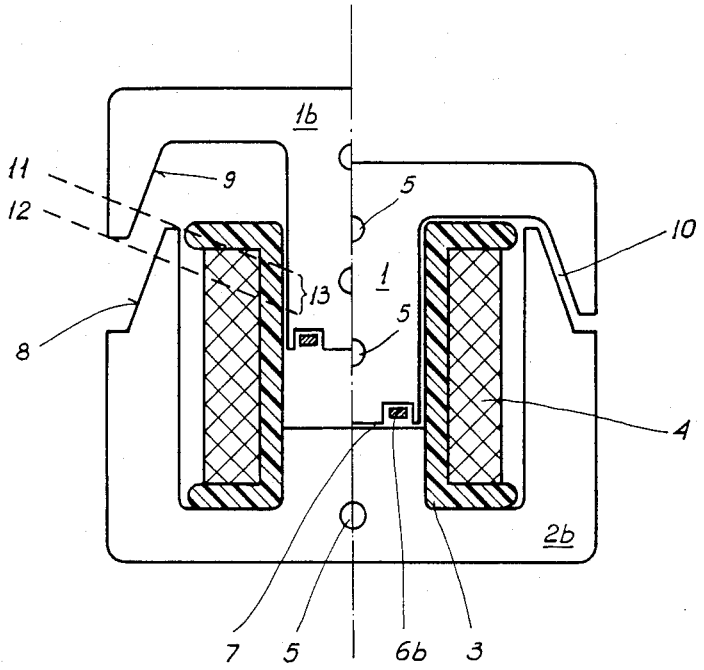
FIG. 3 is similar to FIG. 1, but illustrates a third embodiment of the invention.

FIG. 3 is almost identical in structure and operation to FIG. 1. However, the short circuit ring 6*b* is carried by the armature 1*b*.

What is claimed is:

1. An electromechanical transducer for a limiter switch for alternating current, comprising a coil-supporting bobbin and a pair of magnetic pieces forming an armature and a core, at least one of the armature and core being E-shaped, a central leg of said E-shaped piece coming into contact with the other piece when said transducer is activated, at least one of said central leg and the region of the other piece which faces said central leg carrying a short-circuit ring, the pieces being configured so that in an activated state air gaps exist between both pairs of outer legs of the magnetic pieces, surfaces of the pieces which define the gaps being slanted with respect to a travel direction of the armature.

2. Transducer according to claim 1 in which both the armature and the core are E-shaped.

3. Transducer according to claim 1, in which the armature has a central leg, and that the bobbin forms a guide for said central leg.

4. Transducer according to claim 1, in which the short-circuit ring is held in place by the bobbin.

5. Transducer according to claim 1 in which the surfaces are inclined so that planes normal to the surfaces traverse the bobbin and the central leg of the armature in a region where the bobbin engages the central leg.

6. Transducer according to claim 1 in which only the central leg of said E-shaped pieces comes into contact with the other piece when said transducer is activated.

7. Transducer according to claim 1 in which the central leg of said E-shaped piece comes directly into contact with the other piece.

* * * * *